US007909612B2

(12) United States Patent
Steinkamp et al.

(10) Patent No.: US 7,909,612 B2
(45) Date of Patent: Mar. 22, 2011

(54) RF CONNECTOR MOUNTING MEANS

(75) Inventors: Ulrich Steinkamp, Hannover (DE); Nils Rode, Harsum (DE)

(73) Assignee: Laird Technologies, Inc., Chesterfield, MO (US)

( * ) Notice: Subject to any disclaimer, the term of this patent is extended or adjusted under 35 U.S.C. 154(b) by 302 days.

(21) Appl. No.: 12/161,184

(22) PCT Filed: Jan. 17, 2007

(86) PCT No.: PCT/EP2007/000376

§ 371 (c)(1),
(2), (4) Date: Sep. 12, 2008

(87) PCT Pub. No.: WO2007/082727

PCT Pub. Date: Jul. 26, 2007

(65) Prior Publication Data

US 2010/0255688 A1 Oct. 7, 2010

(30) Foreign Application Priority Data

Jan. 17, 2006 (DE) ..... 20 2006 000 720 U

(51) Int. Cl.
*H01R 12/00* (2006.01)

(52) U.S. Cl. ..... 439/63

(58) Field of Classification Search ..... 439/63, 439/188, 578–585

See application file for complete search history.

(56) References Cited

U.S. PATENT DOCUMENTS 2,878,587 A * 3/1959 Jubenville ..... 434/224
4,012,095 A * 3/1977 Doucet et al. ..... 439/63
4,157,207 A * 6/1979 Robinson ..... 439/82
4,219,251 A * 8/1980 Romine ..... 439/692
4,226,495 A * 10/1980 Palle et al. ..... 439/535
4,603,926 A * 8/1986 Nesbit et al. ..... 439/63
4,645,288 A * 2/1987 Stursa ..... 439/581
4,659,156 A * 4/1987 Johnescu et al. ..... 439/63
4,684,200 A * 8/1987 Capp ..... 439/387
4,824,398 A * 4/1989 Taylor ..... 439/557
4,934,941 A * 6/1990 Okada ..... 439/60

(Continued)

FOREIGN PATENT DOCUMENTS

DE 19716139 6/1998

(Continued)

OTHER PUBLICATIONS

International Search Report dated Apr. 25, 2007 for International Patent Application No. PCT/EP2007/000376 (4 pages).

(Continued)

*Primary Examiner* — T C Patel
*Assistant Examiner* — Vladimir Imas
(74) *Attorney, Agent, or Firm* — Harness, Dickey & Pierce, P.L.C

(57) ABSTRACT

A mounting means (1) for RF connectors (6) to be connected to a substrate (20) comprises a base plate (2) having an upper surface (2*a*) and a lower surface (2*b*). The base plate exhibits electrically leading material at least on part of its surfaces. Ground pads (3) are provided on the upper surface (2*a*) of the base plate (2) and arranged for support and electrical contacting to the substrate. A plurality of through holes (4) for electrically isolated reception of inner conductors (5) of RF connectors. By means of this mounting means, quick, secure, and space-saving mounting of RF connectors is achieved.

22 Claims, 5 Drawing Sheets

U.S. PATENT DOCUMENTS

| | | | | | |
|---|---|---|---|---|---|
| 5,062,811 | A | * | 11/1991 | Hackman | 439/620.03 |
| 5,100,344 | A | * | 3/1992 | Truong | 439/578 |
| 5,120,258 | A | * | 6/1992 | Carlton | 439/581 |
| 5,169,343 | A | * | 12/1992 | Andrews | 439/607.11 |
| 5,522,735 | A | * | 6/1996 | Wright | 439/540.1 |
| D374,863 | S | * | 10/1996 | Grande | D13/146 |
| RE36,065 | E | * | 1/1999 | Andrews et al. | 439/607.11 |
| 6,132,244 | A | * | 10/2000 | Leeman et al. | 439/541.5 |
| 6,152,743 | A | * | 11/2000 | Fox | 439/63 |
| 6,152,750 | A | * | 11/2000 | Huguenet et al. | 439/188 |
| 6,362,709 | B1 | * | 3/2002 | Paxman et al. | 333/245 |
| 6,407,652 | B1 | * | 6/2002 | Kan | 333/260 |
| 6,409,519 | B1 | * | 6/2002 | Bacon | 439/63 |
| 6,457,979 | B1 | * | 10/2002 | Dove et al. | 439/63 |
| 6,468,089 | B1 | * | 10/2002 | Hubbard et al. | 439/63 |
| 6,488,512 | B2 | * | 12/2002 | Gonzales | 439/63 |
| 6,639,154 | B1 | * | 10/2003 | Cartier et al. | 174/255 |
| 6,717,398 | B2 | * | 4/2004 | Cartier | 324/158.1 |
| 6,793,501 | B1 | * | 9/2004 | Leeman et al. | 439/63 |
| 6,808,395 | B2 | * | 10/2004 | Lin et al. | 439/63 |
| 6,942,489 | B2 | * | 9/2005 | Tiesler | 439/34 |
| 6,992,544 | B2 | * | 1/2006 | Barnes et al. | 333/33 |
| 7,015,709 | B2 | * | 3/2006 | Capps et al. | 324/754 |
| 7,118,381 | B2 | * | 10/2006 | Weidner | 439/63 |
| 7,156,675 | B2 | * | 1/2007 | Nagata et al. | 439/188 |
| 7,165,974 | B2 | * | 1/2007 | Kooiman | 439/63 |
| 7,252,513 | B1 | * | 8/2007 | Hildebrand et al. | 439/63 |
| 7,564,417 | B2 | * | 7/2009 | Tengler et al. | 343/715 |
| 7,740,489 | B2 | * | 6/2010 | Trout et al. | 439/75 |
| 7,766,662 | B2 | * | 8/2010 | Akama et al. | 439/63 |
| 2001/0051448 | A1 | * | 12/2001 | Gonzales | 439/63 |
| 2004/0106304 | A1 | * | 6/2004 | Lin et al. | 439/63 |
| 2005/0124178 | A1 | * | 6/2005 | Tiesler | 439/34 |
| 2005/0221631 | A1 | * | 10/2005 | Yamaguchi | 439/63 |
| 2006/0077112 | A1 | * | 4/2006 | Nakano et al. | 343/715 |
| 2008/0272969 | A1 | * | 11/2008 | Tengler et al. | 343/715 |
| 2010/0062634 | A1 | * | 3/2010 | Hardy et al. | 439/359 |

FOREIGN PATENT DOCUMENTS

| | | | | |
|---|---|---|---|---|
| DE | 19716139 | C1 | * | 6/1998 |
| DE | 20 2006 000720 | | | 4/2006 |
| DE | 20 2005 020107 | | | 2/2007 |
| EP | 0632520 | | | 1/1995 |
| EP | 1801932 | A1 | | 6/2007 |
| EP | 1801932 | B1 | | 4/2008 |
| WO | WO 00/28627 | A | | 5/2000 |

OTHER PUBLICATIONS

Written Opinion dated Apr. 25, 2007 for International Patent Application No. PCT/EP2007/000376 (5 pages).

Office Action issued by the European Patent Office dated Oct. 12, 2009 for European Patent Application No. 07702830.6 (3 pages).

* cited by examiner

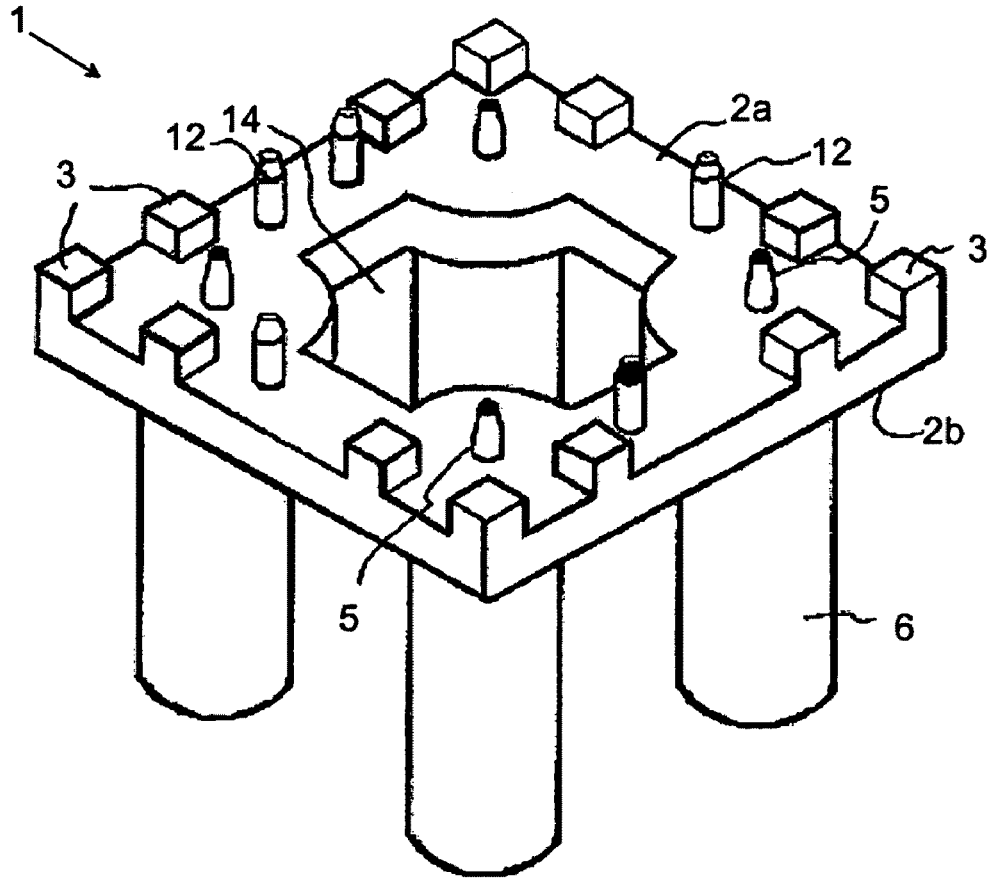
Fig. 4
Fig. 5
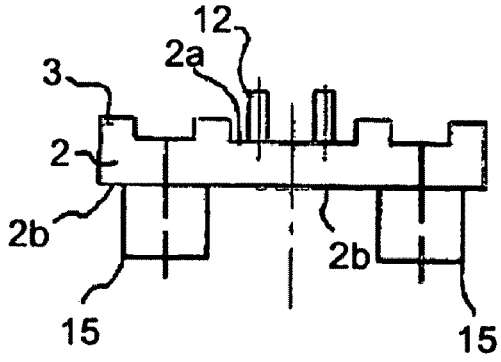

RF CONNECTOR MOUNTING MEANS

FIELD OF INVENTION

The present invention relates generally to a means for mounting RF connectors to for example a printed circuit board and more particularly to a mounting means, which facilitates mounting of RF connectors with high precision. The present invention also relates to an antenna module comprising such mounting means, and a method of mounting RF connectors.

BACKGROUND

Antenna modules for vehicles are generally attached to the roof; the antenna module housing is to this end attached to the roof by means of for example a screw connection and is connected via connectors, such as RF connectors, which generally extend through the vehicle roof and into the interior of the vehicle.

For the contacting of several RF connectors for more complex antenna modules exact positioning of the connectors is necessary since the performance can be adversely affected if the RF connectors are misaligned.

However, there is generally only a limited space available in a lateral direction for the connectors, such as a hole with the size of 15×15 or 17×17 mm, in which four connectors are to be fitted. Exact contacting and assembly are therefore often difficult to achieve.

SUMMARY OF THE INVENTION

An object of the invention is to provide a quick, secure, and/or space-saving mounting of RF connectors to a module, such as an antenna module, to ensure contacting of the RF connectors to the antenna module.

This object is according to a first aspect of the invention achieved by a mounting means for RF connectors according to claim 1. According to other aspects of the invention there are provided an RF connector device according to claim 15, an antenna module according to claim 16, and a method of mounting RF connectors according to claim 17.

The dependent claims describe further preferred embodiments.

The basis of the invention is to first attach one or several RF connectors to a base plate, wherein inner conductors of the connectors extend through the base plate. Thus, the base plate with one or more assigned RF connectors can thereafter be installed directly onto a substrate, such as a printed circuit board, which can take place with a standard mounting (SMD mounting) method.

The outer conductors of the coaxial RF connectors can be provided on and contacted directly to the lower surface of the base plate, wherein the base plate can be made of metal, so that it serves as a common ground for all connectors. The outer conductors can be provided on the frame or provided in corresponding for example socket shaped connector receiving means, which extend from the lower surface of the frame.

Furthermore, coding means are preferably provided to ensure safe, polarity-free mounting of the equipped frame to a printed circuit board.

Ground pads in the form of for example small ground legs or protrusions protrude from the upper surface of the base plate, which serve for contacting the substrate as well as taking up forces. The small ground legs thus take up the forces and bending moments influencing during assembly and loading. The small ground legs are to this end preferably provided laterally outside of the frame. Also the coding means, which in particular can be extending coding pins, serve to take up forces and bending moments to avoid or at least minimizing loading of the inner conductors of the RF connectors.

A substrate, such as a printed circuit board, can be equipped directly with the connector device comprising the base plate and a plurality of RF connectors and the antenna module with its antenna module housing is then attached to the printed circuit board, so that the whole can be fastened as unit to the vehicle roof. There is also the possibility of attaching the connector device to the antenna module housing if this is provided with corresponding attachment means, for example tabs for screw connections or stampings, for example. Hereby is the force application by the connection force conducted onto the antenna module housing.

The tolerances between the RF connectors can be kept small by the use of the base plate, so that a very space saving, narrow RF connector device is made possible. In case of using SMB connectors, for example, tolerances for the distances of the inner conductors from for example 9+/−0.02 mm can hereby be achieved.

BRIEF DESCRIPTION OF DRAWINGS

The invention is now described, by way of example, with reference to the accompanying drawings, in which:

FIG. 4 a perspective view of the connector device shown in FIGS. 1-3;

FIG. 5 is a side view of an alternative embodiment of a base plate comprised in a mounting means according to the invention;

DETAILED DESCRIPTION OF PREFERRED EMBODIMENTS

Figure 1:
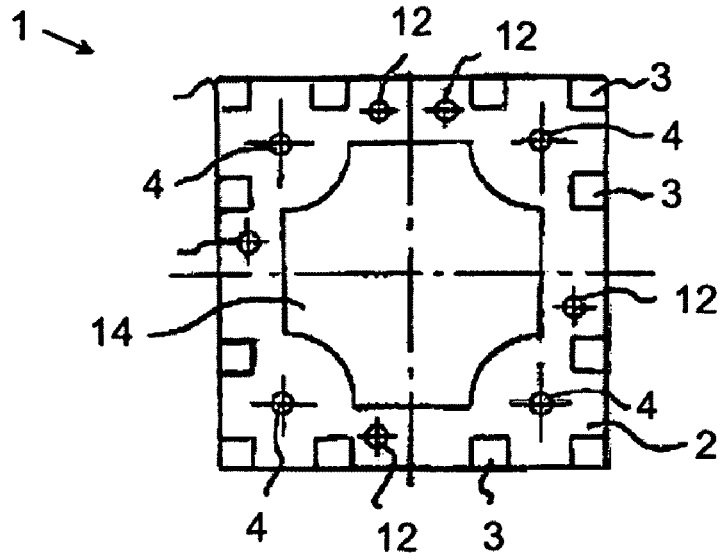
FIG. 1 a plan view of a base plate comprised in an RF connector device according to invention.

In the following a detailed description of preferred embodiments of the present invention will be given. It will be realized that the directions given in this description, such as upper and lower, are intended for non-limiting explanation only and refer to the directions shown in the figures.

An RF connector device or frame 1 comprises in accordance with FIGS. 1-4 a base plate 2 made of metal material having an upper surface 2*a* and a lower surface 2*b*. Ground pads in the form of small metal ground legs or protrusions 3 extend from the upper surface 2*a* of the base plate 2. These legs are preferably integral with the rest of the base plate, thus forming a unitary unit. Through holes 4 are provided in the base plate 2, which in the shown embodiment are four symmetrically arranged holes in the corner areas of the base plate. These through holes extend from the upper surface 2*a* down to the lower surface 2*b* and are arranged to receive a respective inner conductor 5 of RF connectors 6 inserted into these through holes 4 from the lower surface of the base plate.

The RF connectors 6 can for example be connectors sold under the trademark FAKRA and are designed as coaxial connectors comprising a dielectric 8 and an outer conductor 10 around the inner conductor 5. The inner conductors 5 are provided isolated through the base plate 2 and extend as shown in the side view of the FIG. 2 to the upper surface 2*a* of the base plate, so that they there can be further contacted, as will be described below.

The outer conductor 10 is contacted to the frame 1, e.g., by simply resting on or being soldered to the base plate 2. This base plate 2 thus appears as a common ground to the outer conductors 10 of several, for example four assigned RF connectors 6, and is also contacted through its small ground legs 3.

In the shown embodiment, three ground legs 3 are provided around a through hole 4 to form a semi coaxial screen around each of the inner conductors 5 which extend through the holes 4.

One or more coding pins 12 extend from the upper surface 2*a* of the base plate 2 and are arranged asymmetrically and exchange-safely, so that they enable a predetermined positioning of the base plate and prevent a 90°, 180°, or 270° rotated mounting of the equipped base plate to a substrate.

The base plate 2 exhibits a recess or opening, which according to the shown embodiment is provided in the center of the base plate 2. This opening can however also be omitted in accordance with other embodiments.

In accordance with the alternative embodiment shown in FIG. 5 complementary connector receiving means 15 are provided on the lower surface 2*b* of the base plate 2, which facilitates mounting of the RF connectors 6 to the base plate 2. A complete RF connector 6 can hereby be inserted, so that its outer conductor 10 contacts the connector mounting means 15. The RF connectors 6 can alternatively at their ends be laid bare from their outer conductors 10, so that the connectors 6 are inserted only with their inner conductors 5 and their dielectric into the connector receiving means 15, whereby the connector receiving means 15 make contact with the ends of the shortened outer conductors 10 at the front side.

The length L of the RF connectors 6 can vary but the dimensioning of the connector device 1 can nevertheless be kept very exact, so that placement of the RF connectors 6 becomes possible with small tolerances. The base plate can for example be square shaped with a length of 17+/−3 mm, wherein the distance of the through holes 4 and thus also the assigned inner conductors 5 can be accurately provided at a mutual distance of 9+/−0.02 mm.

A method of mounting RF connectors will now be described with reference to FIGS. 6-12. First, RF connectors 6 are attached to the base plate 2 so that the respective inner conductor extends through an assigned through hole 4 in the base plate. The connector device 1 in FIG. 1 to FIG. 4 formed in this way by the base plate 2 and assigned connectors 6 is subsequently attached to a substrate 20, such as a printed circuit board, see FIG. 7. The ground legs or protrusions 3 are thereby placed on corresponding ground means, such as ground contacts or contact pads on the lower surface of the printed circuit board 20, preferably attached by means of solder and/or conductive adhesive, and the coding pins 12 are placed in corresponding recesses in the printed circuit board 20 and attached by means of for example a paste. The inner conductors 5 of the connectors 6 are contacted to the printed circuit board 20 with corresponding connections by means of soldering, for example. The inner conductors 5 preferably have a length so that they extend through the printed circuit board 20 to the upper surface thereof, where they can be contacted.

Thus there is provided a positioning of several connectors 6 on the printed circuit board 20, which is compact, very exact and with small tolerances. The connectors 6 are hereby provided directly to the base plate 2 and the complete equipped connector device 1 is subsequently provided on the printed circuit board 20, which preferably take place in an SMD mounting process.

Figure 7:
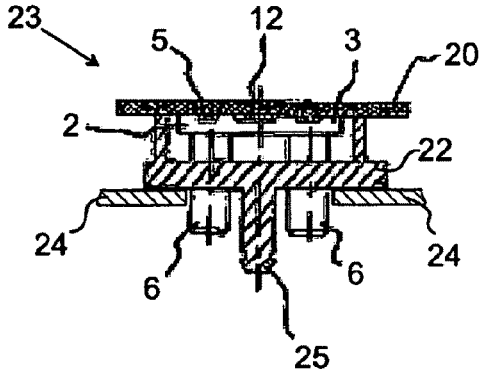
FIGS. 7-9 show sectional views of alternative embodiments of an antenna module according to the invention attached to a vehicle roof.
Figure 8:
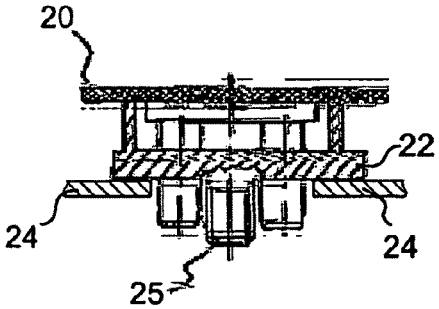
Figure 9:
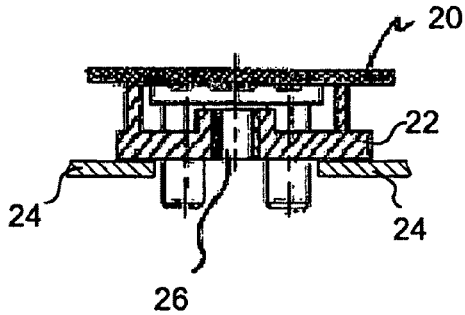

In accordance with FIGS. 7-9 the printed circuit board 20 is attached to an antenna module chassis 22, so that an entire module 23 of the parts 2, 6, 20, and 22 can be attached to a vehicle roof 24 by means of for example an attachment bolt 25, see FIG. 7 or 8, or a bolt 27 (shown in FIG. 10) inserted into a threaded hole 26 in the chassis 22, see FIG. 9. In order to keep dimensions small, the bolt is preferably of the dimension M5 or M6, attached with a torque of about 2.5-3.0 Nm. The RF connectors 6 hereby extend through a corresponding hole in the vehicle roof 24 and can be contacted from below.

The small ground legs 3 and the coding pins 12 take according to invention up the arising forces and bending moments, so that loading of the inner conductors 5 is avoided or at least minimized.

Figure 10:
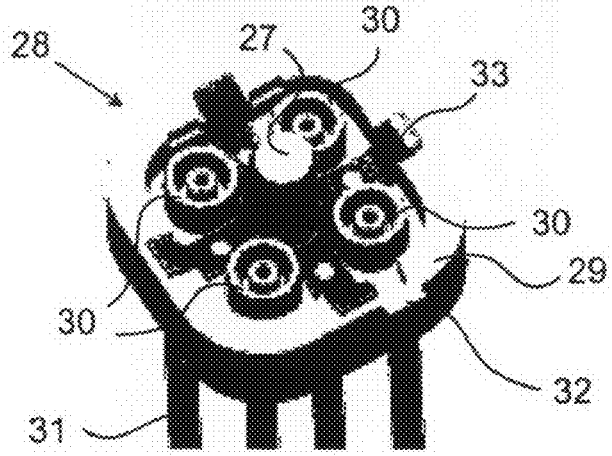
FIG. 10 shows a complement unit connectable to an RF connector device according to the invention.

A complementary unit 28 will now be described with reference to FIG. 10. This unit comprises a housing or bracket 29 which encloses a plurality of RF couplers 30, wherein each of the RF couplers is arranged to connect to a corresponding one of the plurality of RF connectors 6 on the connector device 1. The RF couplers 30 are connected to an RF harness cable 31, which connects the antenna module to the electronics of the vehicle to which the antenna module is attached.

The bracket 29 is provided with a snap-in 32 arranged to cooperate with a snap nose provided on a mounting clip, as will be described below with reference to FIG. 11.

The complementary unit 28 finally comprises a bracket metal sheet 33 for grounding purposes.

Figure 11:
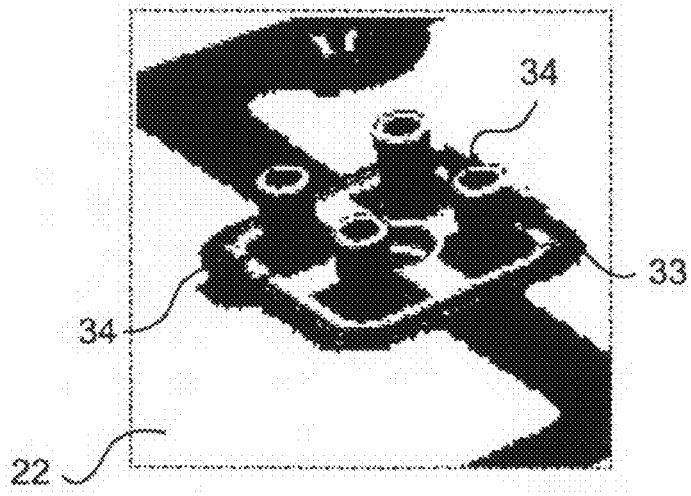
FIG. 11 is a detailed view of an antenna module provided with an RF connector device according to the invention.

Turning now to FIG. 11, the antenna module chassis 22 is provided with a clip 33 of electrically non-conducting material, such as plastic, which is used for pre-fixation of the antenna module on the vehicle roof 24. This is achieved by means of a snap nose 34, which is part of the clip 33. The snap nose also functions as a coding during mounting of the complement unit to the antenna module. This means that the snap nose 34 and the snap 32 of the complement unit must be aligned in order to attach the complement unit, eliminating the risk of incorrect rotation of the complement unit.

Thus, the method of mounting the antenna module comprises attaching the printed circuit board 20 to the chassis 22 of the antenna module, where after the antenna module housing is attached. The antenna module is then placed on the vehicle roof so that the connectors 6 are aligned with the hole in the vehicle roof. This is preferably achieved by means of the pre-fixation clip 33. The mounting procedure is completed by attaching the complement unit 28 to the antenna module by means of the screw 27.

Figure 12:
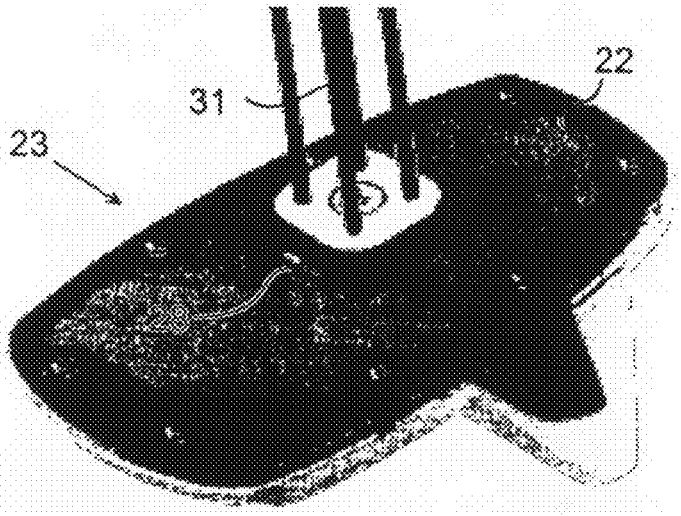
FIG. 12 shows the antenna module of FIG. 11 provided with the complement of FIG. 10.

In FIG. 12, the entire antenna module 23 is shown with the attached complement unit 28. The vehicle roof to which the antenna module is to be attached is omitted for clarity.

Figure 2:
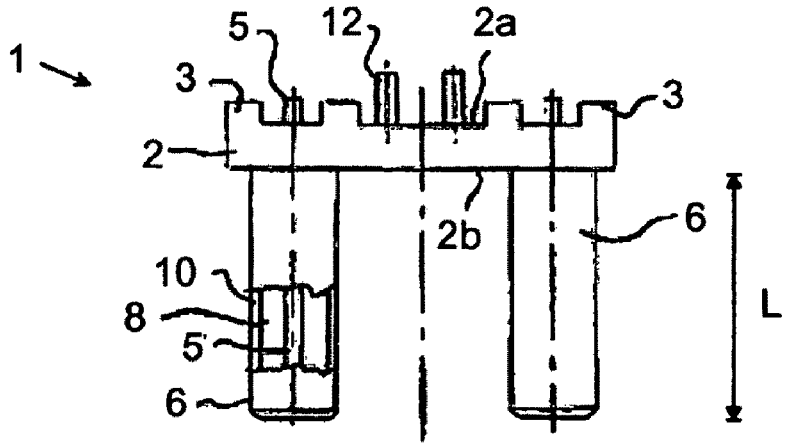
FIG. 2 a side view of the base plate of FIG. 1 provided with RF connectors.
Figure 3:
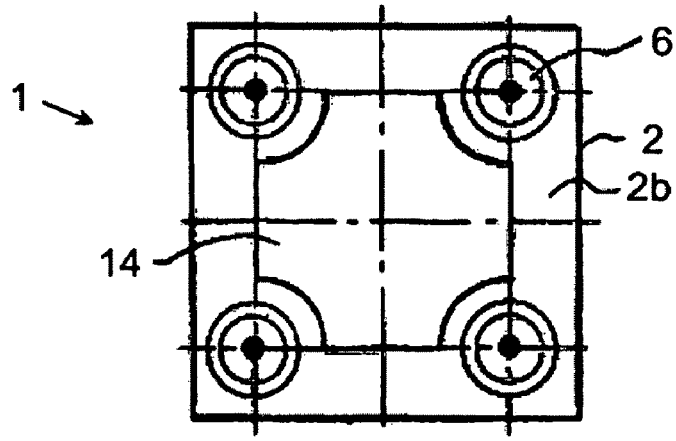
FIG. 3 is a bottom view of the base plate and connectors shown in FIG. 2.
Figure 6:
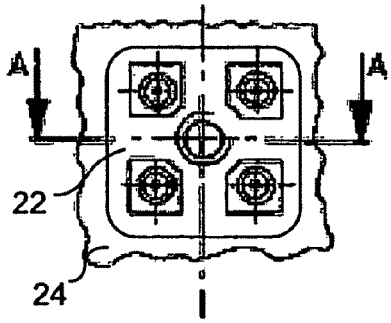
FIG. 6 shows a plan view from below of an RF connector device according to the invention attached to a vehicle roof.
Figure 13:
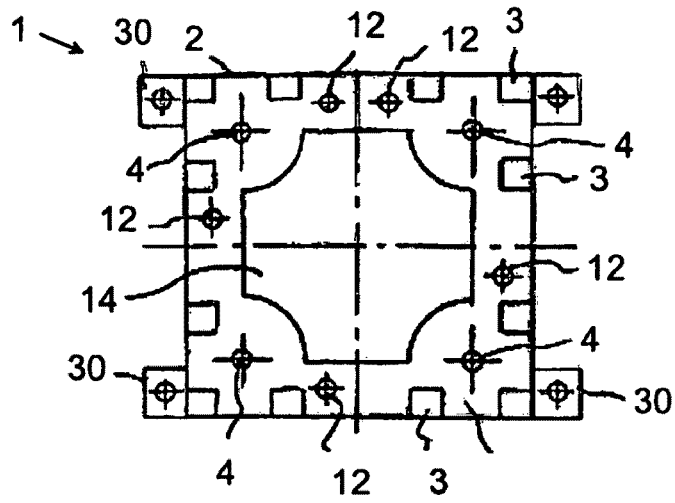
FIGS. 13-15 show an alternative embodiment of an RF connector device modified from the one shown in FIGS. 1-3.
Figure 14:
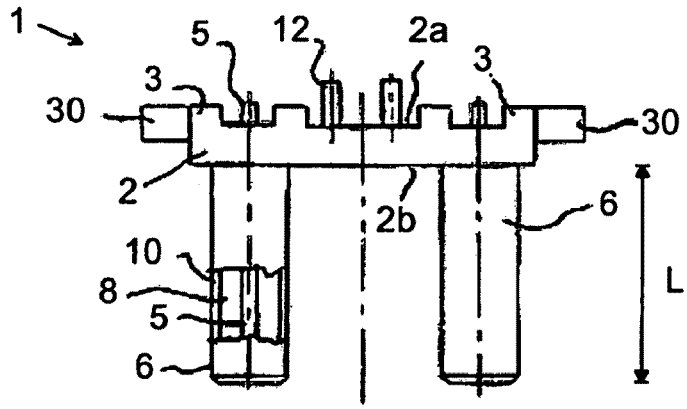
Figure 15:
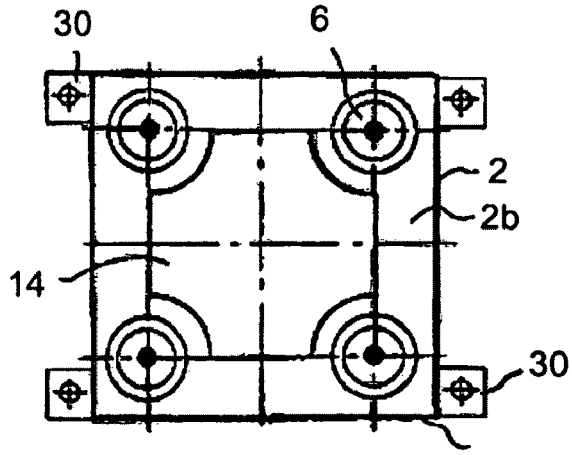

FIGS. 13-15 show an alternative embodiment, wherein the base plate 2 shown in FIG. 1 to FIG. 3 has been modified by the addition of tabs or tongues 35, through which the force application can be diverted also directly into the antenna module housing 22. The tabs 30 can for this extend laterally.

The base plate 2 can be made completely of metal, for example as a pressure casting part from brass with galvanization, or from steel or aluminum. Alternatively part of or the entire surface of the base plate is electrically conductive and the interior is made of some suitable electrically non-conductive material, such as plastic.

Preferred embodiments of a mounting means, an RF connector device, and an antenna module have been described. It will be appreciated that these embodiments can be modified without departing from the inventive idea as defined by the appended claims. Thus, each base plate can hold fewer or more than four connectors, depending on the application.

The ground pads on the base plate have been described as small legs extending from the upper surface of the base plate. It will be appreciated that these ground pads can take other shapes and can for example be flush with the upper surface of the base plate.

In the described antenna module, the connectors 6 are RF connectors adapted to transmit signals in the radio frequency range. It will be appreciated that the inventive idea is applicable to any kind of connector and particularly connector arrangements wherein the demands on mounting tolerances are strict.

An antenna module arranged for mounting to a vehicle has been described. It will be appreciated that the inventive idea is applicable to any antenna module, such as antenna modules intended for indoor mounting.

The invention claimed is:

1. A mounting means for RF connectors to be connected to a substrate, comprising:

a base plate having an upper surface and a lower surface, which base plate exhibits electrically leading material at least on part of its upper and lower surfaces;

ground pads on the upper surface of the base plate and arranged for support and electrical contacting to the substrate; and a plurality of through holes for electrically isolated reception of inner conductors of RF connectors, wherein the lower surface comprises electrically leading material arranged such that an outer conductor of RF connectors when connected to the mounting means contacts the electrically leading material, thereby enabling the base plate to serve as common ground of the mounting means.

2. The mounting means according to claim 1, wherein the upper surface of the base plate includes coding means for exchange-safe attachment to the substrate.

3. The mounting means according to claim 2, wherein the coding means comprise protruding coding pins for insertion into corresponding holes in the substrate.

4. The mounting means according to claim 1, wherein the ground pads comprise small legs or protrusions extending from the upper surface of the base plate.

5. The mounting means according to claim 4, wherein the ground pads are arranged laterally outside of the through holes.

6. The mounting means according to claim 1, wherein a plurality of ground pads surround each through hole for semi coaxial shielding of an inner conductor provided in the respective through hole.

7. The mounting means according to claim 1, wherein the ground pads are symmetrical in a lateral outer area of the upper surface of the base plate.

8. The mounting means according to claim 1, further comprising socket shaped connector receiving means on the lower surface of the base plate for reception of RF connectors.

9. The mounting means according to claim 8, wherein the connector receiving means are configured to allow complete RF connectors with outer conductors to be insertable into the connector receiving means.

10. The mounting means according to claim 8, wherein a dielectric and an inner conductor of an RF connector are insertable into the connector receiving means without an outer conductor.

11. The mounting means according to claim 1, wherein the mutual distance of the through holes exhibits a tolerance equal to or less than 0.03 millimeters.

12. The mounting means according to claim 1, wherein the through holes for reception of the inner conductor are arranged symmetrically on the base plate.

13. The mounting means according to claim 1, comprising attachment means for direct mounting to and force application to a housing.

14. The mounting means according to claim 13, wherein the attachment means comprises tabs extending laterally from the base plate.

15. A connector device including the mounting means of claim 1, and further comprising:

a plurality of electrical connectors attached to the mounting means, the plurality of electrical connectors, each electrical connector comprising a respective inner conductor and a respective outer conductor, wherein the inner conductor of each electrical connector is inserted in a through hole of the base plate from the lower surface of the base plate and extends to the upper surface of the base plate, and the outer conductor of each electrical connector is electrically connected to the ground pads of the base plate.

16. An antenna module including the connector device of claim 15, and further comprising:

a substrate, and a module chassis, wherein:

the ground pads rest against and are in electrical contact with ground means on the substrate;

the inner conductors are in electrical contact with associated electrically conductive means on the substrate; and the substrate is attached to the module chassis.

17. A method of mounting RF connectors, the method comprising:

attaching a plurality of RF connectors to a base plate having an upper surface and a lower surface, each of the upper and lower surfaces comprising an electrically conductive material;

providing inner conductors of the RF connectors in a respective through hole in the base plate such that the electrically conductive material of the lower surface contacts the outer conductors;

electrically connecting outer conductors of the RF connectors to the base plate;

attaching the base plate to a substrate;

electrically connecting ground pads on the base plate to ground means on the substrate; and electrically connecting the inner conductors to corresponding connections on the substrate.

18. The method according to claim 17, further comprising attaching the substrate to a chassis of an antenna module.

19. The method according to claim 18, further comprising:

providing the antenna module on the roof of a vehicle; and attaching a complement unit comprising RF couplers to the antenna module, wherein each of the RF couplers is connected to a respective RF connector.

20. An RF connector device for connecting to a substrate, the RF connector device comprising:

multiple RF connectors, each RF connector having a inner conductor and an outer conductor; and a base plate having an upper surface and a lower surface, the base plate including an electrically conductive material on at least a portion of the lower surface;

the base plate having multiple holes, each one of the holes coupling and electrically isolating the inner conductor of one of the multiple RF connectors, the base plate including at least two ground pads associated with each inner conductor on the upper surface, the ground pads configured to be surface mounted to a substrate thereby creating electrical contact between the base plate and the substrate;

the electrically conductive material on the at least a portion of the lower surface being arranged such that an outer conductor of an RF connector when connected to the RF connector device contacts the electrically conductive material, thereby enabling the base plate to serve as common ground of the RF connector device.

21. The RF connector device of claim 20, wherein the base plate includes three ground pads associated with each of the inner conductors on the upper surface.

22. The RF connector device of claim 20, wherein the at least two ground pads associated with each inner conductor are equidistance from said inner conductor.

* * * * *